US005784739A

United States Patent [19]

Kawada et al.

[11] Patent Number: 5,784,739

[45] Date of Patent: Jul. 28, 1998

[54] SUPER-LONG SPAN SUSPENSION BRIDGE

[75] Inventors: Tadaki Kawada, Musashino; Masahiro Yoneda, Izumi; Shunzo Nakazaki, Urawa, all of Japan

[73] Assignee: Kawada Industries, Inc., Tokyo, Japan

[21] Appl. No.: 720,688

[22] Filed: Oct. 2, 1996

[30] Foreign Application Priority Data

Oct. 16, 1995 [JP] Japan ..... 7-291691

[51] Int. Cl.[6] ..... E01D 11/02

[52] U.S. Cl. ..... 14/18; 14/19

[58] Field of Search ..... 14/18, 19, 20, 14/21, 23, 78

[56] References Cited

U.S. PATENT DOCUMENTS 4,451,950 6/1984 Richardson ..... 14/18
4,665,578 5/1987 Kawada et al. .
5,539,946 7/1996 Kawada .

FOREIGN PATENT DOCUMENTS 47-44944 11/1972 Japan .
60-192447 9/1985 Japan .
63-134701 6/1988 Japan .
7-119116 9/1995 Japan .

*Primary Examiner*—James Lisehora
*Attorney, Agent, or Firm*—Frishauf, Holtz, Goodman, Langer & Chick

[57] ABSTRACT

As a countermeasure against storms for long span, particularly super-long span suspension bridges with the center span exceeding 2,000 m, there is provided a super-long span suspension bridge which can be improved of its static and dynamic wind resistance performance by applying a mass to a portion of the girder. In a suspension bridge with the center span exceeding 2,000 m, a mass application member capable of temporarily carrying a predetermined amount of additional load is provided on either side of the stiffening girder for a distance equal to ⅓ at the maximum of the center span so that a mass weighing 30% or less of the weight of the girder is temporarily applied in the mass application member in the girder on the windward side when the bridge is subjected to a storm, and cross stays are provided each at a point inward from either end of the center span section at a distance equal to ¼ to ⅓ of the center span.

3 Claims, 7 Drawing Sheets

SUPER-LONG SPAN SUSPENSION BRIDGE

BACKGROUND OF THE INVENTION AND RELATED ART STATEMENT

The present invention relates to suspension bridges, and more particularly to the structure of a super-long span suspension bridge having a center span of more than 2,000 m aimed-at improving the static and aerodynamic stability against wind during stormy weather.

As a countermeasure against winds for suspension bridges, it has been known to provide an additional mass such as water and concrete in the stiffening girder of the bridge to suppress vertical and torsional vibrations of the girder (e.g. Japanese Patent Publication No. Sho 47-44,944; Japanese Patent Application (JPA) Lay-open No. Sho 60-192,007; U.S. Pat. No. 4,665,578; JPA Lay-open No. Sho 63-134,701; JPA Lay-open No. Hei 7-119,116; EPA No. 641,888 A3 and U.S. Pat. No. 5,539,946).

While suspension bridges disclosed in Japanese Patent Publication No. Sho 47-44,944 and JPA Lay-open No. Sho 63-134,701 utilize the kinetic energy of water pooled in advance in the stiffening girder to absorb the vertical and torsional vibrations occurring in the girder during the storm, those disclosed in JPA Lay-open No. Sho 60-192,007 and U.S. Pat. No. 4,665,578 employ a predetermined amount of additional load fixed in the stiffening girder to suppress such vertical and torsional vibrations.

According to JPA Lay-open No. Hei 7-119,116, EPA No. 641,888 A3 and U.S. Pat. No. 5,539,946, the dead load under normal conditions is set as light as when no live load is applied, and an additional mass is applied temporarily only during a storm to the stiffening girder to improve its flutter resistance, whereby the vertical and torsional vibrations during the storm are suppressed.

According to Japanese Patent Publication No. Sho 47-44, 944, JPA Lay-open Nos. Sho 63-134,701, Sho 60-192,007 and U.S. Pat. No. 4,665,578, the additional load which acts to suppress the vertical and torsional vibrations in the stiffening girder must be incorporated as a dead load in the form of water, concrete or the like in the stiffening girder or the tower at the stage of designing.

Generally, suspension bridges are designed by considering the normal conditions when the dead load and the live load, mainly of moving vehicles such as automobiles and trains, act on the bridge, and the stormy conditions when the wind load as well as the dead load plays a vital role. The smaller the dead load of the main cable, anchors, towers, hangers, etc. that are designed by considering the vertical load, the better it is in terms of economy under the normal conditions. Conversely, the heavier the dead load, the better the static and aerodynamic stabilities against vibrations would be under stormy conditions. However, countermeasures against storms where an additional mass of water, concrete or the like is applied to the girder in advance as the dead load are defective in that economy of designing the main cable, anchor, tower and hanger on the basis of the vertical loads under the normal conditions is sacrificed because of the increase in the dead load.

With the conventional suspension bridges having a center span of up to 1,500 m, torsional flutter is often the predominant vibration factor that determines the storm resistance. In the case of super-long span bridges having a center span of more than 2,000 m, however, so-called coupled flutter in which bending and torsion are coupled is the predominant factor that determines the wind resistance. It is critically important to devise measures to raise the wind speed at which the coupled flutter occurs (coupled flutter speed) to a level above the required value (velocity). From the standpoint of this so-called coupled flutter, the temporary application of additional mass on the girder during a storm such as disclosed in JPA Lay-open No. Hei 7-119,116, EPA No. 641,888 A3 and U.S. Pat. No. 5,539,946 is not satisfactory in that a considerably large amount of additional mass is necessary in order to increase the coupled flutter speed to a level which is significantly high in terms of engineering, because such an additional mass must be applied along the center portion of the girder cross section.

SUMMARY OF THE INVENTION

The present invention basically follows the concept of JPA Lay-open No. Hei 7-119,116, EPA No. 641,888 A3 and U.S. Pat. No. 5,539,946 in that an additional mass is temporarily applied during a storm to suppress the vertical and torsional vibrations in the stiffening girder and that its dead load under normal conditions is set as light as when no live load is applied.

An object of the present invention is to solve the problem encountered in the prior art that the level of wind speed at which coupled flutter occurs in a super-long span suspension bridge during a storm cannot be raised unless a considerable amount of additional mass is applied because the temporary load is applied at the center portion of the girder cross section, and to thereby raise the coupled flutter speed by a relatively small amount of additional mass.

To achieve the above object, the present invention super-long span suspension bridge having the center span of longer than 2,000 m comprises a main cable, anchors retaining the tension generating at the main cable, plural towers supporting the main cable, a stiffening girder for distributing the live load working on the bridge floor, and hangers suspending the stiffening girder from the main cable and is characterized in that a temporary mass application member which carries a predetermined amount of additional mass is provided on each side of the stiffening girder for a distance equal to or less than ⅓ of the center span so that, during a storm, a mass weighing 30% or less of the weight of the stiffening girder is temporarily applied on said mass application member on the windward side, and further characterized in that plural cross stays are provided each at a point inward from each end of the center span section for a distance equal to ¼ to ⅓ of the center span.

As the load to be applied in the temporary mass application member provided in the center span section of the stiffening girder on the windward side for the distance of ⅓ at the maximum of the length of the center span, it is possible to utilize mass application tanks each provided with a pump and a valve which are disposed in the stiffening girder at both ends of said center span section and liquid such as water that can be charged into and discharged from respective tanks.

Under the normal conditions, said mass application tanks are kept empty. If a typhoon is forecast, water is supplied into either one of the tanks through a water pipe and retained therein by closing the valve to apply a predetermined amount of additional load. As the predetermined amount of water is pooled inside the tank, water remaining in the pipe is evacuated toward the ends of the bridge so that water is pooled only in the tank. After the typhoon, water inside the tank is returned via the pipe to empty the tank.

According to the present invention suspension bridge, a temporary mass application member is provided on each side of the stiffening girder for a distance equal to ⅓ at the maximum of the center span, so that an additional mass weighing 30% or less of the weight of the stiffening girder is temporarily applied only in said member on the windward side of the bridge during a storm. Further, cross stays are provided each at a point inward from both ends of the center span section 1 for a distance of ¼ to ⅓ of the center span, so that even with suspension bridges having a center span of longer than 2,000 m, the level of the wind speed at which the coupled flutter would occur due to strong winds can be raised to as high as 80 m/sec, which is the required velocity of 78 m/sec for a super-long bridge such as Akashi Channel Bridge, by applying a relatively small amount of additional mass. The present invention is an effective countermeasure for such super-long span suspension bridges against heavy storms.

DETAILED DESCRIPTION OF THE PREFERRED EMBODIMENTS

Figure 1:
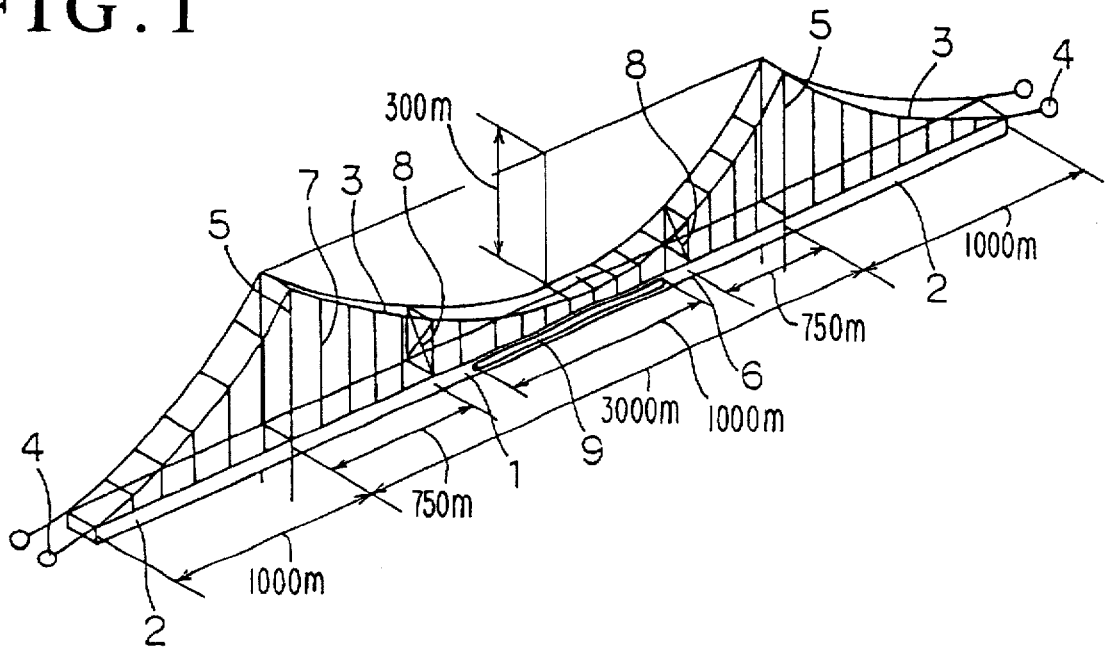
FIG. 1 is a perspective view to show the basic construction of the model suspension bridge A as the first embodiment of the present invention.

The present invention super-long span suspension bridge will now be described by way of embodiments shown in the drawings, wherein FIG. 1 is a perspective view of a model bridge A according to the first embodiment. Basically the bridge has a center span longer than 2,000 m, and cross stays 8 are each provided at a point inward from the both ends of the center span section 1 for a distance equal to ¼ to ⅓ of the center span. A temporary mass application member 9 is provided on either side of the center span section 1 so that a mass weighing 30% or less of the weight of the stiffening girder can be applied on the windward side of the center span section 1 at its center.

Embodiment 1

Figure 2:
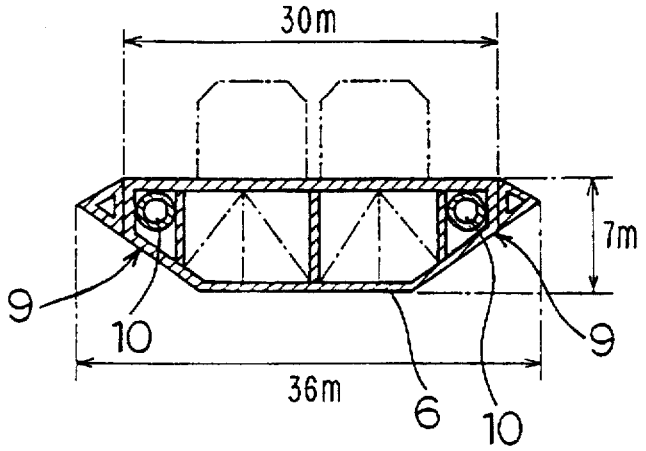
FIG. 2 is a sectional view of the bridge shown in FIG. 1 along the bridge width in the center span section.

The model bridge A comprises a main cable 3, anchors 4 retaining the tension generating at the main cable 3, plural towers 5 supporting the main cable 3, and hangers 7 for suspending from the main cable 3 the stiffening girder 6 which distributes the live load acting on the bridge floor. The center span section 1 measures 3,000 m in length, the side span section 2 on both ends is 1,000 long, the sagging ratio is 1/10 (300 m) and the stiffening girder 6 is 7 m high as shown in FIG. 2. The structural dimensions are shown in Table 1 below.

Structural Dimensions and Properties

Weight (tf/m/Br)

| | |
|---|---|
| Cable | 18.0 |
| Stiffening girder | 19.5 |
| Total weight | 37.5 |

Polar Moment of Inertia ($tfm^2/m/Br$)

| | |
|---|---|
| Cable | 2100 |
| Stiffening girder | 4050 |
| Total weight | 6150 |

Girder stiffness ($m^4/Br$)
(Moment of inertia of area)

| | |
|---|---|
| Secondary moment of in-plane section | 11.0 |
| Secondary moment of out-plane section | 110.0 |
| Torsion constant | 22.0 |
| Area of cable ($m^2/Br$) | 2.0 |

Figure 3:
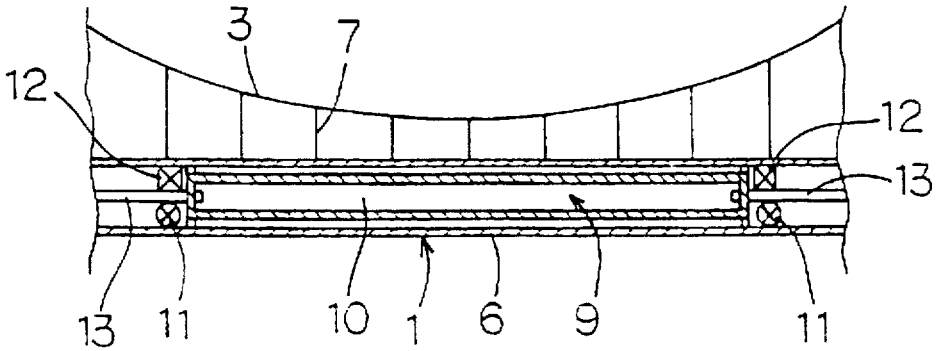
FIG. 3 is a partial longitudinal section of the bridge shown in FIG. 1 along the bridge length in the center span section.

As shown in FIGS. 2 and 3, there is provided a mass application tank 10 each in a temporary mass application member 9 provided on either side of the stiffening girder 6 and extending along the bridge axis for a distance equal to ⅓ at the maximum (1,000 m) of the center span section 1 at the center, the tank capacity being such that a liquid load such as fresh or sea water weighing 30% or less (5.85 tf/m) of the weight of the girder can be added.

A cross stay 8 is each provided on the hanger 7 at a point inward from either end of the center span section 1 for a distance equal to ¼ of the center span or at a point 750 m from the tower 5, respectively, the cross stay measuring 0.0075 $m^2$ in sectional area.

The tank 10 provided inside the girder 6 is an elongated tube made of an elongated sheet of rubber or plastic and having such design length and thickness to retain a predetermined volume of water as shown in FIG. 3. Under the normal conditions, the tank is kept empty to avoid excessive load on the girder 6 and designed that when water is pooled therein during a storm, it can freely accommodate the vibration of the girder 6. A predetermined amount of fresh or sea water can be supplied through a water pipe 13 that extends from the direction of the side span section 2 by means of a pump 11 and a valve 12 provided at a suitable position respectively.

Although said embodiment uses an elongated and flexible sheet of rubber or plastics as the material for the tank 10, the tank may be made of a metal such as aluminum.

Under the normal conditions, the tank 10 is empty, and as soon as a typhoon is forecast and data such as its direction and the maximum instantaneous wind velocity become available, the tank 10 on the windward side alone is supplied via the water pipe 13 from the land or the sea with a liquid load weighing 30% of the weight of the girder. When there is no longer the effect of the winds of the typhoon, the valve 12 of the tank 10 is opened and the pump 11 actuated to discharge water inside to release the additional temporary load.

Figure 4:
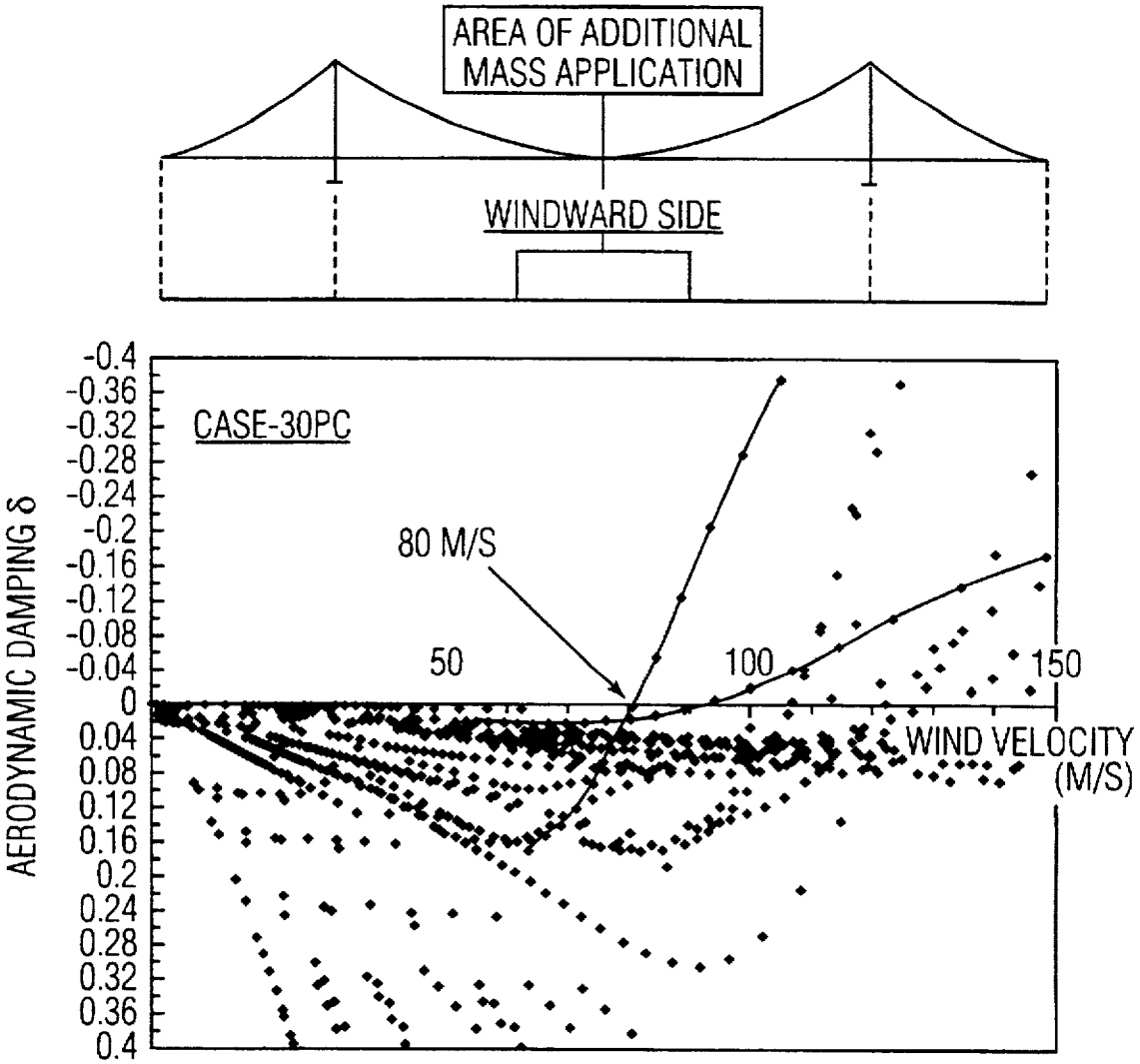
FIG. 4 shows the relation between the wind velocity and the aerodynamic damping obtained in the analysis of coupled flutter on the model bridge A of the first embodiment.

FIG. 4 shows the relation between wind velocity and aerodynamic damping (Relation V–δ) obtained in the coupled flutter analysis based on the static characteristics and intrinsic vibrational characteristics of the model bridge A. As can be seen from the figure, the wind speed at which the coupled flutter (80 m/sec) occurs (coupled flutter speed) exceeds the required velocity of 78 m/sec for Akashi Channel Bridge when the tank 10 on the windward side and extending for the length of 1,000 m at the center of the center span section 1 is applied with a mass equal to 30% of the weight of the girder (5.85 tf/m).

Embodiment 2

Figure 5:
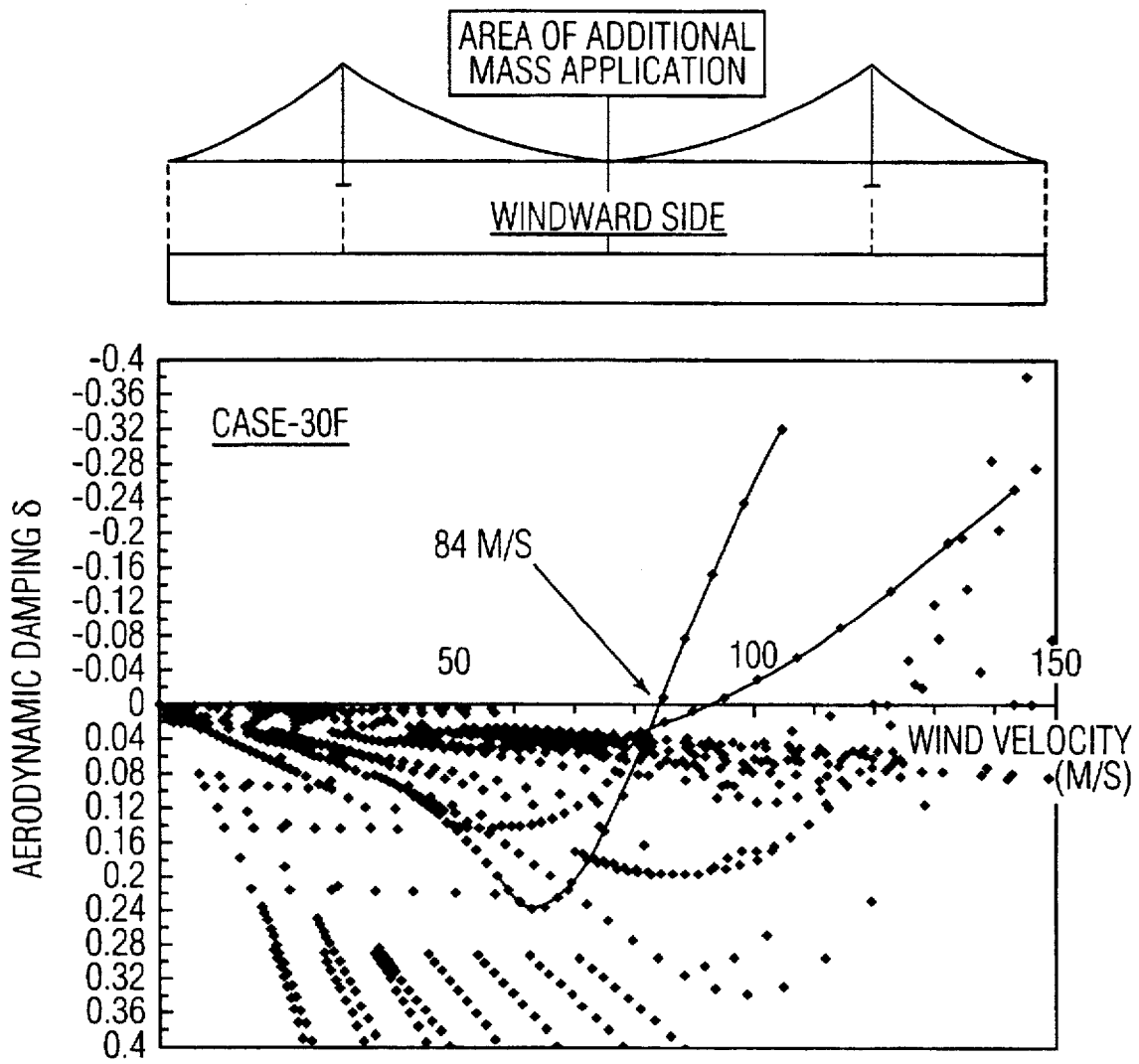
FIG. 5 shows the relation between the wind velocity and the aerodynamic damping obtained in the analysis of coupled flutter on the model bridge B of the second embodiment.

FIG. 5 shows the relation between wind velocity and aerodynamic damping (Relation V–δ) obtained in the coupled flutter analysis of the model bridge B of Comparative Embodiment 2. The model bridge B has the same structural dimensions and properties as the model bridge A, but the additional mass weighing 30% or less of the weight of the girder is applied over the entire length of the bridge on the windward side including the side span sections 2 and the center span section 1.

As is clear from FIG. 5, although the coupled flutter speed in the model bridge B of Embodiment 2 has increased to 84 m/sec which is significantly high in terms of design wind resistance, there is no significant difference from the increase achieved in the model bridge A wherein the same amount of additional mass is applied only on the center portion of the center span section on the windward side. This means that it is useless to apply the additional mass over the entire length of the center span section 1 and the side span sections 2.

Embodiment 3

Figure 6:
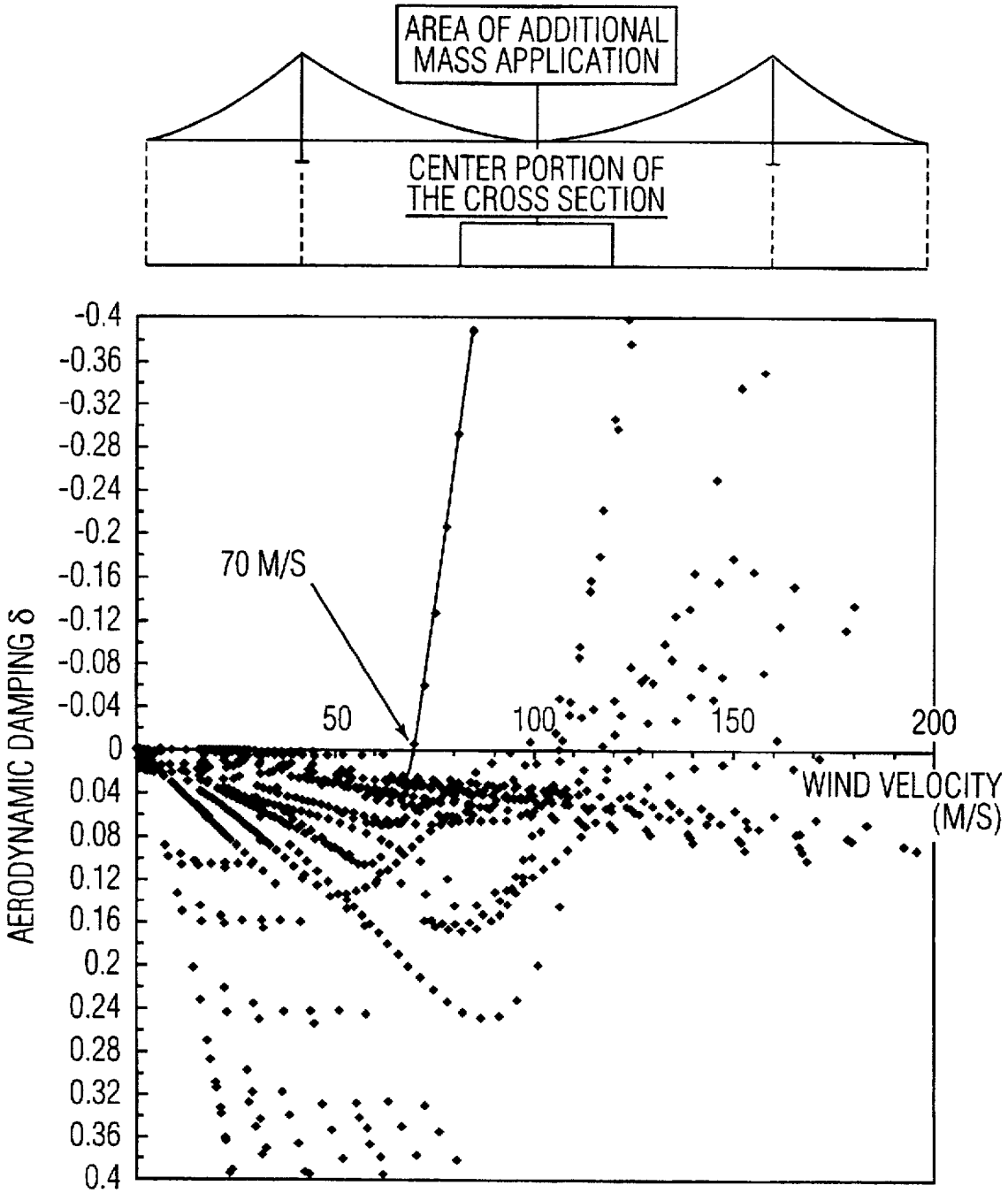
FIG. 6 shows the relation between the wind velocity and the aerodynamic damping obtained in the analysis of coupled flutter on the model bridge C of the third embodiment.

FIG. 6 shows the relation between wind velocity and aerodynamic damping (Relation V–δ) obtained in the coupled flutter analysis of the model bridge C of Comparative Embodiment 3. The model bridge C has the same structural dimensions and properties as the model bridge A, but the additional mass weighing 30% or less of the weight of the girder is applied for the length of 1,000 m along the center line of the bridge cross section in the center span section 1.

As is clear from FIG. 6, the coupled flutter speed in the model bridge C has increased to 70 m/sec, but the increase is not significant enough in terms of design wind resistance, indicating that it is less effective when compared with the model bridge A in which the additional mass is applied on the windward side of the center span section 1 at the center thereof.

Embodiment 4

Figure 7:
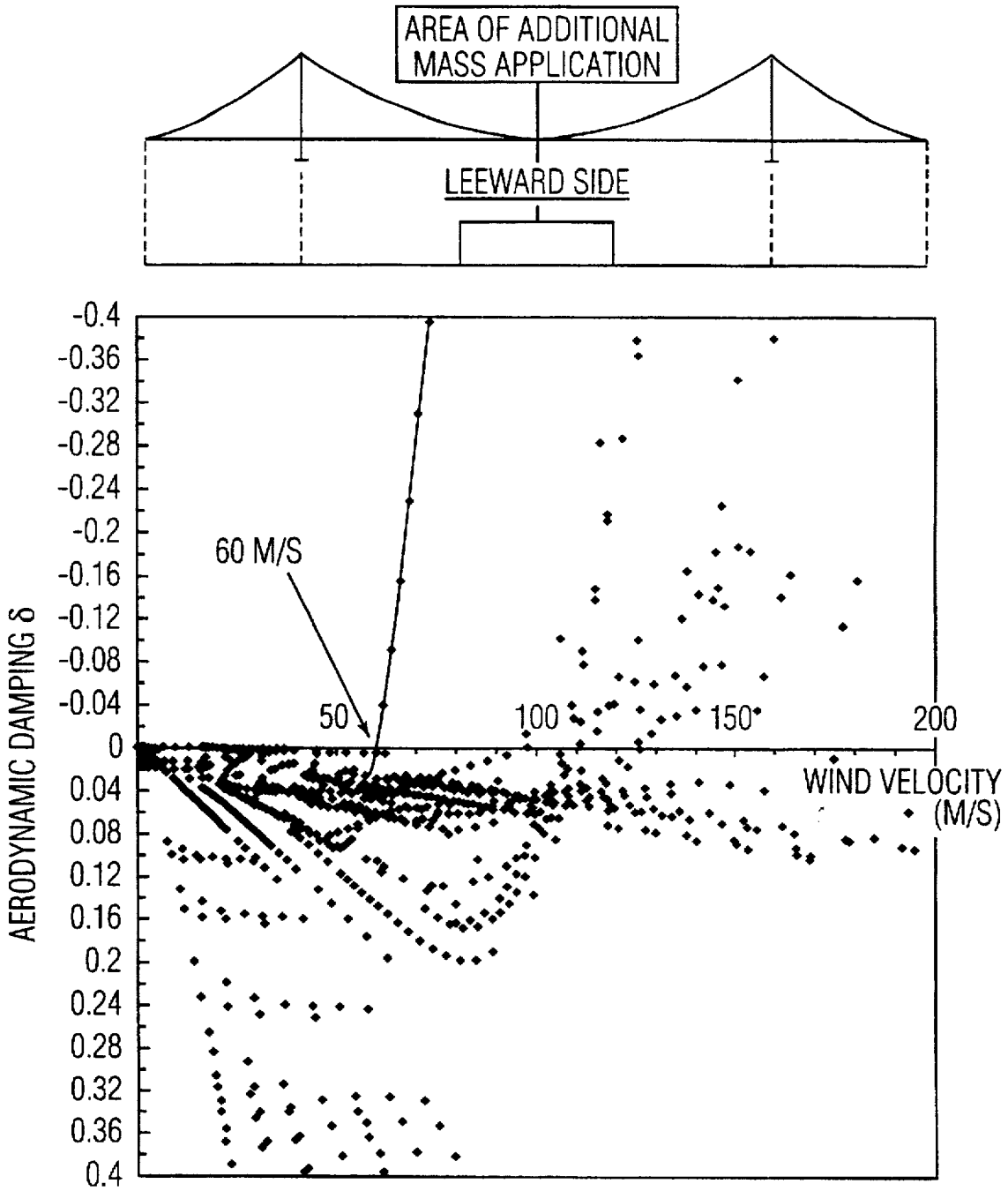
FIG. 7 shows the relation between the wind velocity and the aerodynamic damping obtained in the analysis of coupled flutter on the model bridge D of the fourth embodiment.

FIG. 7 shows the relation between wind velocity and aerodynamic damping (Relation V–δ) obtained in the coupled flutter analysis of the model bridge D of Comparative Embodiment 4. The model bridge D has the same structural dimensions and properties as the model bridge A, but the additional mass weighing 30% or less of the weight of the girder is applied in the center span section 1 for a distance of 1,000 m at the center thereof on the leeward side.

As is clear from FIG. 7, although the coupled flutter speed in the model bridge D of Embodiment 4 has increased to 60 m/sec, the increase is insignificant in terms of design wind resistance, indicating that it is far less effective compared to the model bridge A wherein the mass is applied on the windward side of the center of the center span section 1.

Embodiment 5

Figure 8:
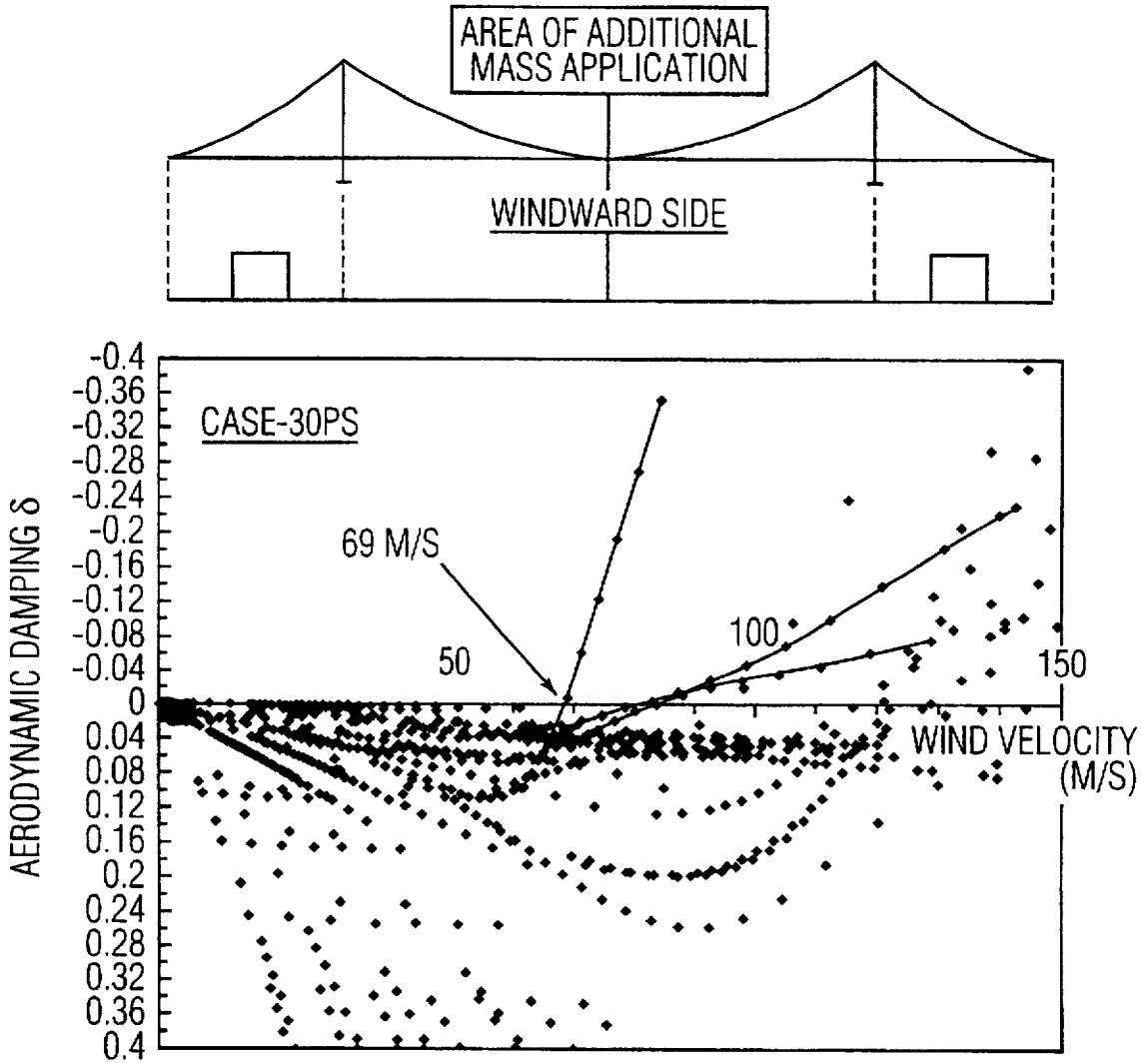
FIG. 8 shows the relation between the wind velocity and the aerodynamic damping obtained in the analysis of coupled flutter on the model bridge E of the fifth embodiment.

FIG. 8 shows the relation between wind velocity and aerodynamic damping (Relation V–δ) obtained in the coupled flutter analysis of the model bridge E of Comparative Embodiment 5. The model bridge E has the same structural dimensions and properties as the model bridge A, but the additional mass weighing 30% or less of the weight of the girder is applied on the windward side of the side span sections 2 for the length of 333 m at the center thereof.

As is clear from FIG. 8, the coupled flutter speed in the model bridge E of Embodiment 5 is 69 m/sec, indicating that additional mass applied in the side span sections 2 is less effective when compared to applying the additional mass on the windward side of the center span section 1 at its center.

Embodiment 6

Figure 9:
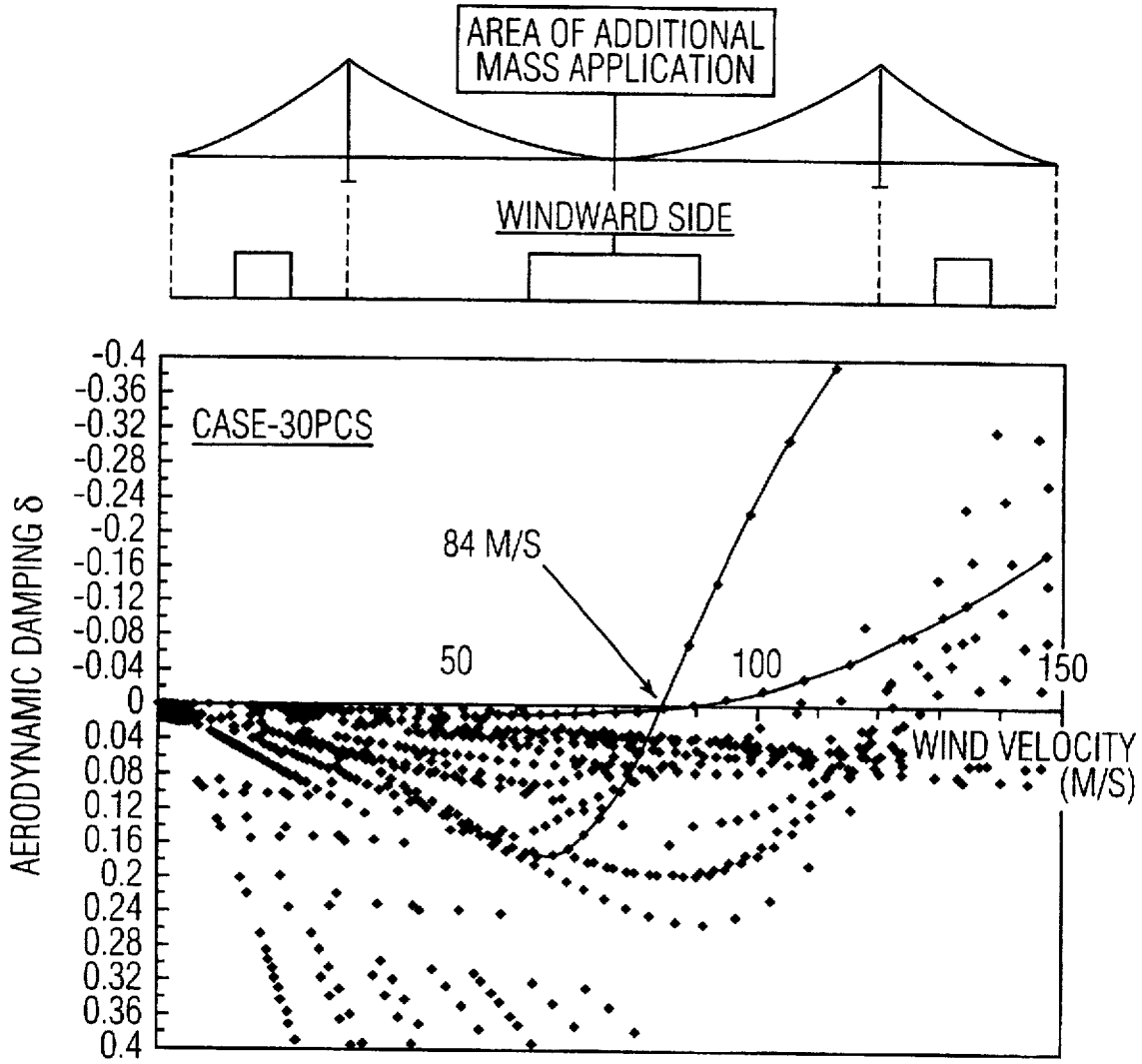
FIG. 9 shows the relation between the wind velocity and the aerodynamic damping obtained in the analysis of coupled flutter on the model bridge F of the sixth embodiment.

FIG. 9 shows the relation between wind velocity and aerodynamic damping (Relation V–δ) obtained in the coupled flutter analysis of the model bridge F of Comparative Embodiment 6. The model bridge F has the same structural dimensions and properties as the model bridge A, but the additional mass weighing 30% or less of the weight of the girder is applied on the windward side of the center span section 1 at its center for the length of 1,000 m and the windward side of the side span sections 2 for the length of 333 m at the center thereof respectively.

As is clear from FIG. 9, although the coupled flutter speed in the model bridge F of Embodiment 6 has increased significantly to 84 m/sec, there is no significant difference from the increase achieved in the model bridge A wherein the additional mass is applied on the windward side of the center span section 1 at its center, indicating that it is useless to apply the additional mass in the center span section 1 and the side span sections 2 separately.

In the experiments that were conducted concurrently, the additional mass applied on the windward side of the center span section 1 at its center was increased to 50%, 70% and 90% of the weight of the girder. The coupled flutter speed did increase under the additional load as high as those, but there would be an increase in the static torsional angle which would cause unsteady drag force that can not be disregarded. It is therefore preferable to set the amount of additional mass to be applied at 30% or less of the weight of the girder.

In another experiment in which no cross stay 8 was provided, the coupled flutter speed was 63.5 m/sec when the additional mass weighing 30% of the weight of the girder was applied on the windward side of the center span section 1 at its center. As shown in FIG. 3, however, the coupled flutter speed increased to 80 m/sec when cross stays 8 were each provided at a point inward from both ends of the center span section 1 for a distance equal to ¼ to ⅓ of the center span.

That the coupled flutter speed increased by the provision of cross stays 8 is because there was an increase in the equivalent polar moment of inertia of the vibrational mode (lateral vibration mode accompanying torsional deformation of the girder) which is involved in the occurrence of coupled flutter. It suffices if a pair of cross stays 8 are provided at a point inward from both ends of the center span section for a distance of ¼ to ⅓ of the center span 1. It was found that increase in the number of cross stays would not result in increase in the coupled flutter speed.

What is claimed is:

1. A super-long suspension bridge comprising a a main cable having a tension, a plurality of anchors retaining the tension occurring in the cable, a plurality of towers supporting the main cable and including first and second towers which are adjacent to one another, a center span having a center span length which is equal to the distance between said first and second towers, said center span length being larger than 2,000 m, a bridge floor having a live load acting thereon, a stiffening girder distributing the live load acting on the bridge floor, a plurality of hangers suspending the stiffening girder from the main cable, first and second temporary mass application members, said first temporary mass application member being capable of temporarily applying a predetermined amount of additional load on a first side of the stiffening girder and said second temporary mass application member being capable of temporarily applying a predetermined amount of additional load on a second side of the stiffening girder, said first and second temporary mass application members being located at and being coextensive with a center portion of said center span, said center portion having a center portion length equal to ⅓ of the center span length and one of said first and second temporary mass application members being on a windward side of said center span during a storm, a mass weighing 30% or less of the weight of the girder temporarily applied in said one of said mass application members on the windward side alone during a storm, a first cross stay provided at a point inward from said first tower at a distance equal to ¼ to ⅓ of the center span length, and a second cross stay provided at a point inward from said second tower at a distance equal to ¼ to ⅓ of said center span length.

2. The super-long span suspension bridge as claimed in claim 1, wherein the mass applied in said one of said first and second temporary mass application members on the windward side comprises:

a mass application tank arranged in the girder and provided with a pump and a valve at each end of said center portion along the bridge axis, and liquid such as water that can be freely charged, retained and discharged in and from the tank.

3. The super-long span suspension bridge as claimed in claim 2, wherein said mass application tank comprises a flexible tube made of an elongated rubber or plastic sheet.

* * * * *